US011180304B2

(12) United States Patent
Lee

(10) Patent No.: US 11,180,304 B2
(45) Date of Patent: Nov. 23, 2021

(54) HETEROGENEOUS CONTENTS MIXING VESSEL

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 122 days.

(21) Appl. No.: 16/821,851

(22) Filed: Mar. 17, 2020

(65) Prior Publication Data

US 2020/0307891 A1 Oct. 1, 2020

(30) Foreign Application Priority Data

Mar. 28, 2019 (KR) ..... 10-2019-35981
Jun. 18, 2019 (KR) ..... 10-2019-72258

(51) Int. Cl.
*B05B 11/00* (2006.01)
*B65D 81/32* (2006.01)
(Continued)

(52) U.S. Cl.
CPC ..... *B65D 81/3227* (2013.01); *A45D 34/06* (2013.01); *A45D 40/24* (2013.01); *B05B 11/0078* (2013.01); *B05B 11/3001* (2013.01); *B05B 11/3084* (2013.01); *A45D 33/24* (2013.01); *A45D 2200/055* (2013.01)

(58) Field of Classification Search
CPC .. A45D 40/24; A45D 2200/055; A45D 34/06; A45D 33/24; B65D 81/3227; B65D 81/3283; B65D 81/3288; B05B 11/0054; B05B 11/0078; B05B 11/3001;
(Continued)

(56) References Cited

U.S. PATENT DOCUMENTS 3,439,841 A * 4/1969 Rhodes ..... B65D 81/3227 222/142.5
4,355,739 A * 10/1982 Vierkotter ..... B05B 11/3083 222/134
(Continued)

FOREIGN PATENT DOCUMENTS

KR 20-0390095 Y1 7/2005
KR 10-1923306 B1 11/2018

*Primary Examiner* — Patrick M. Buechner
(74) *Attorney, Agent, or Firm* — Heedong Chae; Lucem, PC

(57) ABSTRACT

Disclosed is an heterogeneous contents mixing vessel including: a first vessel formed therein with a content storage space and a discharge device accommodation space that are separately defined; a second vessel coupled below the first vessel; first and second discharge devices configured to discharge contents stored in the first vessel and contents stored in the second vessel, respectively; and a push button configured to simultaneously actuate the first and second discharge devices and formed therein with first and second discharge passages connected to the first and second discharge devices, respectively, and first and second discharge ports, wherein a connection grooves is formed in the first vessel and an inlet portion is formed in the second vessel so as to be coupled to each other, so that a separated second discharge device is connected through a connection member.

10 Claims, 8 Drawing Sheets

(51) Int. Cl.
*A45D 40/24* (2006.01)
*A45D 34/06* (2006.01)
*A45D 33/24* (2006.01)

(58) Field of Classification Search
CPC . B05B 11/3081; B05B 11/3084; B05B 15/30; B05B 11/0044
See application file for complete search history.

(56) References Cited

U.S. PATENT DOCUMENTS 5,301,850 A * 4/1994 Gueret ..... A45D 34/04 222/494
5,305,810 A * 4/1994 Meshberg ..... B05B 11/0027 141/374
5,339,990 A * 8/1994 Wilder ..... B05B 11/3001 222/135
2005/0042122 A1* 2/2005 Arghyris ..... B05B 11/3074 417/521
2005/0115988 A1* 6/2005 Law ..... B05B 11/3087 222/145.5
2011/0108507 A1* 5/2011 Sullivan ..... B65D 11/188 215/40
2011/0108581 A1* 5/2011 Dennis ..... B05B 11/001 222/382
2018/0279743 A1* 10/2018 Yoo ..... B05B 11/0081

* cited by examiner

HETEROGENEOUS CONTENTS MIXING VESSEL

BACKGROUND

1. Field of the Invention

The present invention relates to a heterogeneous contents mixing vessel, and more particularly, to a heterogeneous contents mixing vessel in which first and second vessels storing mutually different contents therein are vertically coupled to each other, and the separated discharge device is connected through a connection member at the same time the coupling of the first and second vessels, so that the first and second vessels can be easily coupled to each other and contents can be prevented from being contaminated due to external foreign substances or—spilled to the outside.

2. Description of the Related Art

In general, there are many cases where two or more different contents are mixed and used in order to multiply the efficacy or effect of cosmetics or medicines contained in a vessel.

However, after the contents are mixed and then the mixed contents are stored in a single vessel, when the mixed contents are put into circulation or kept, a chemical reaction may occur in the vessel to cause the mixed contents to coagulate or precipitate, so that a discharge error may occur or the mixed contents may be discolored or deteriorated.

Thus, according to the related art, after different contents are kept in separate vessels, respectively, the contents are individually discharged and mixed directly when used by a user or the different contents are stored in separate vessels. Then, the contents are used after inlets of the two vessels are opened and the contents are mixed in a separate vessel. However, according to the above-described method, the user is required to directly mix and use the contents stored in a separate vessel, the risk of loss increases and the portability decreases.

Therefore, in recent years, a mixing material vessel has been developed such that different contents may be mixed and used by user's operation when necessary, where the different contents are kept in a single vessel while being isolated from each other and stored in a single vessel.

In the related art, Korean Patent Registration No. 10-1923306 discloses a heterogeneous material mixing vessel. According to the above related art, an inner vessel is inserted and mounted to an outer vessel, each of the vessel is equipped with one of pump sets, and mutually different cosmetics are stored in the outer vessel and the inner vessel, respectively, so that the different kinds of cosmetic contents can be simultaneously discharged, mixed and used with one pumping.

However, since the related art has a structure in which the inner vessel is accommodated together with the cosmetic contents stored in the outer vessel, external foreign substances placed on an outer periphery of the inner vessel enter an inside of the outer vessel in the process of assembling or replacing the inner vessel in the outer vessel, and thus the cosmetic contents stored in the outer vessel are contaminated.

In addition, according to the related art, when the outer vessel and the inner vessel containing mutually different contents are packed separately and then assembled and used by a purchaser, the entire vessel is inserted into an inlet portion of the opened outer vessel and thus the contents stored in the outer vessel overflow to the outside due to the volume or sudden insertion of the inner vessel and contaminate the surroundings, and the assembly is inconvenient.

Patent Document

Korean Utility Model Registration No. 20-0390095 (published on Jul. 18, 2005) entitled by "ESSENCE COSMETIC CASE FOR MIXING POWDER"

Korean Patent Registration No. 10-1923306 (published on Nov. 28, 2018) entitled by "HETEROGENEOUS MATERIAL MIXING VESSEL"

SUMMARY

The present invention provides a heterogeneous contents mixing vessel, wherein first and second vessels for storing mutually different contents are connected to first and second discharge devices, respectively, to allow the heterogeneous contents to be discharged to the outside at once by a press action of a push button, in which the first and second vessels are vertically screw-coupled to each other, and the separated second discharge device is connected through the connection member at the same time the coupling of the first and second vessels, so that the first and second vessels can be easily coupled to each other and contents can be prevented from being contaminated due to external foreign substances or becoming dirty after spilled to the outside, during the coupling.

The present invention provides a heterogeneous contents mixing vessel including: a first vessel formed therein with a content storage space and a discharge means accommodation space that are separately defined; a second vessel coupled at a lower portion of the first vessel; first and second discharge devices configured to discharge contents stored in the first vessel and contents stored in the second vessel, respectively; and a push button configured to simultaneously actuate the first and second discharge devices and formed therein with first and second discharge passages connected to the first and second discharge devices, respectively, and first and second discharge ports, wherein a connection grooves formed in the first vessel and an inlet portion formed in the second vessel are coupled to each other, and a separated second discharge device is connected through a connection member.

In addition, the first vessel may include a first upper vessel and a first lower vessel that are coupled to each other.

In addition, the first upper vessel may be formed with a support plate to which the first discharge device and the second discharge device may be partially installed.

In addition, a sealing member may be formed between the first upper vessel and the first lower vessel to block an open portion of the first lower vessel, and the first and second discharge devices may pass through the sealing member.

In addition, the first vessel and the second vessel may be screw-coupled to each other.

In addition, the connection groove of the first vessel and the inlet portion of the second vessel may be positioned to be biased to one side from centers of the first and second vessels.

In addition, the connection member may be provided at the inlet portion of the second vessel, and include an upper connection portion protruding toward the open portion of the inlet portion and connected to a second housing of the second discharge device when the first and second vessels are coupled to each other, a lower connection portion protruding toward an inside of the second vessel and connected to a second suction pipe of the second discharge device, and a coupling portion coupled to the inlet portion.

In addition, at least one air flow hole may be formed in outer sides of the upper connection portion and the lower connection portion of the connection member.

In addition, the first and second discharge devices may include pumps configured to discharge the contents to the outside by pumping.

In addition, a second housing of the second discharge device may be installed to the first vessel, a second suction pipe of the second discharge device may be installed to the connection member so as to be inserted into the second vessel, and the second housing and the second suction tube of the second discharge device may be automatically connected to each other by the connection member when the first vessel is coupled to the second vessel.

According to an embodiment of the present invention, first and second vessels for storing mutually different contents may be connected to first and second discharge devices, respectively, and the heterogeneous contents may be discharged to the outside at once by a press action of a push button, in which the first and second vessels may be vertically screw-coupled to each other. The separated second discharge device may be connected through the connection member at the same time the coupling of the first and second vessels, so that the first and second vessels can be easily coupled to each other and the contents can be prevented from being contaminated due to external foreign substances or becoming dirty after spilled to the outside, during the coupling.

DETAILED DESCRIPTION OF THE EMBODIMENTS

Figure 1:
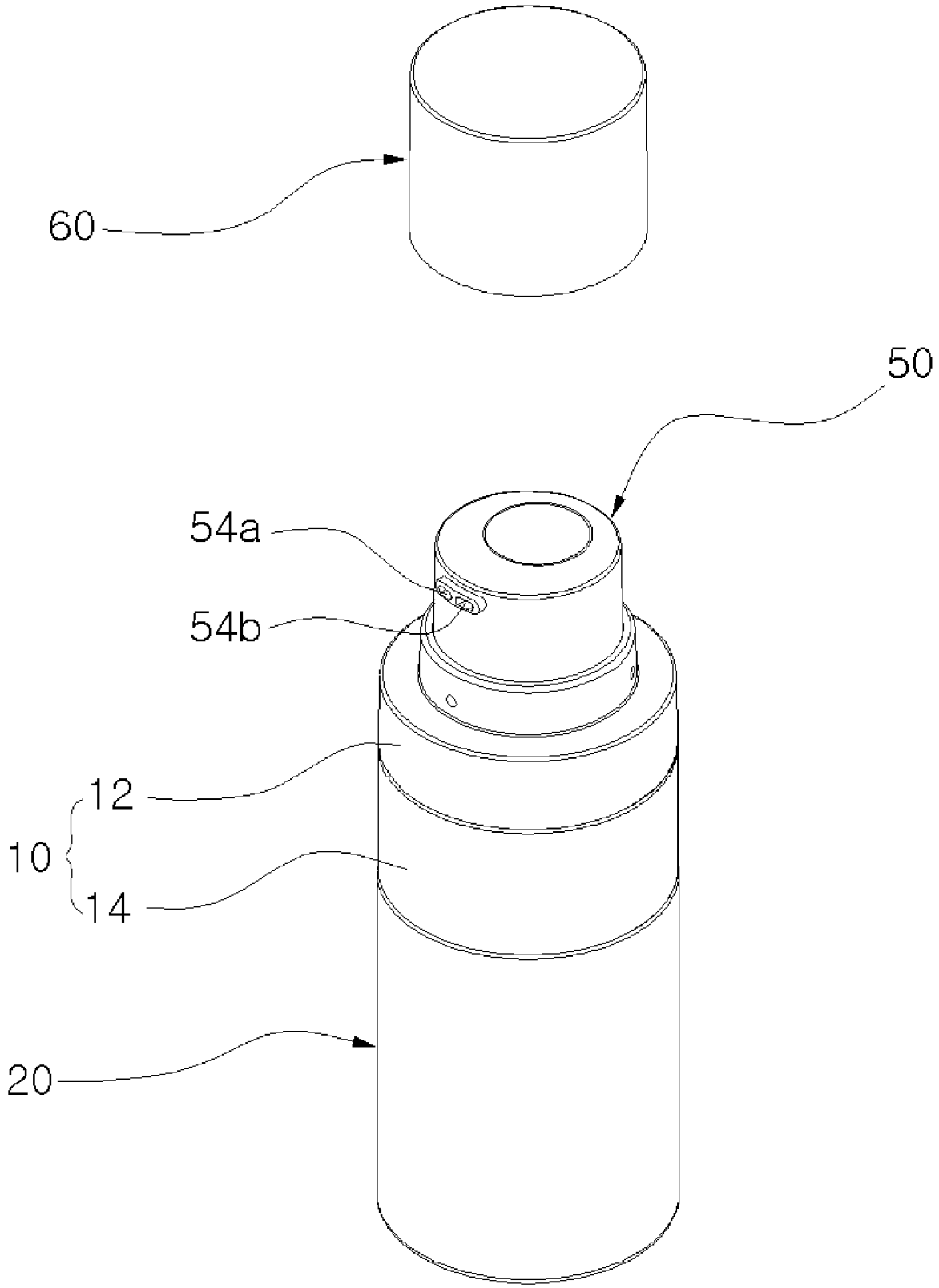
FIG. 1 is a perspective view of a mixing vessel according to the embodiment of the present invention.

Hereinafter, the detailed descriptions of the present invention are embodiments for carrying out the present invention, and the corresponding embodiment refers to the accompanying drawings as an example. The embodiments will be described in detail to enable those skilled in the art to carry out the present invention. It is apparent to be understood that the various embodiments of the present invention may be different from each other but do not need to be mutually exclusive. For example, the particular shape, structure, and feature described herein may be embodied in other embodiments without departing from the idea and scope of the present invention in connection with the embodiment. In addition, it shall be understood that the location or arrangement of an individual element within each disclosed embodiment may be modified without departing from the idea and scope of the present invention.

Accordingly, the following detailed description does not disclose a limited meaning, and the scope of the invention is limited only by the appended claims, along with the full scope of equivalents to which the claims are entitled, if properly explained. Similar reference numerals in the drawings refer to the same or similar function throughout several aspects.

Although general terms which are widely used recently have been selected in the present invention while taking into consideration the function according to the present invention as possible, the terms may vary depending on the intention of those skilled in the art, judicial cases, the advent of new technology, or the like. In addition, in certain cases, the terms may be arbitrarily selected by the applicant. In this case, the meaning thereof will be described in detail in the relevant description of the invention. Accordingly, the terms used in the present invention should be defined based on the meaning of the term and contents throughout the present invention, not simply on names of the terms.

When one part "includes" one element in the present invention, the above expression does not exclude other elements, but may further include the other elements, unless particularly stated otherwise.

The heterogeneous contents mixing vessel according to one embodiment of the present invention will be described with reference to FIGS. 1 to 8.

Figure 2:
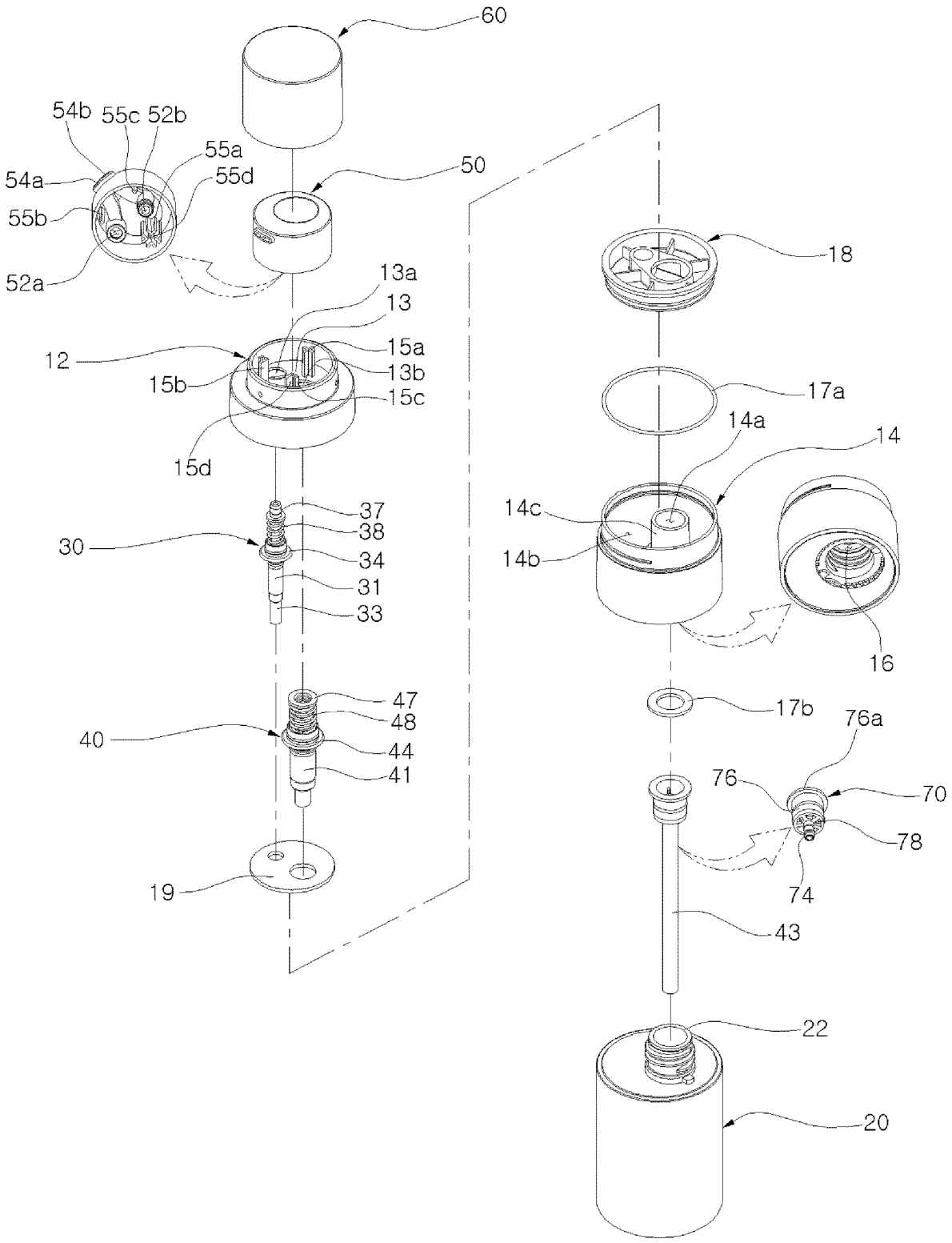
FIG. 2 is an exploded perspective view of the mixing vessel according to the embodiment of the present invention.
Figure 3:
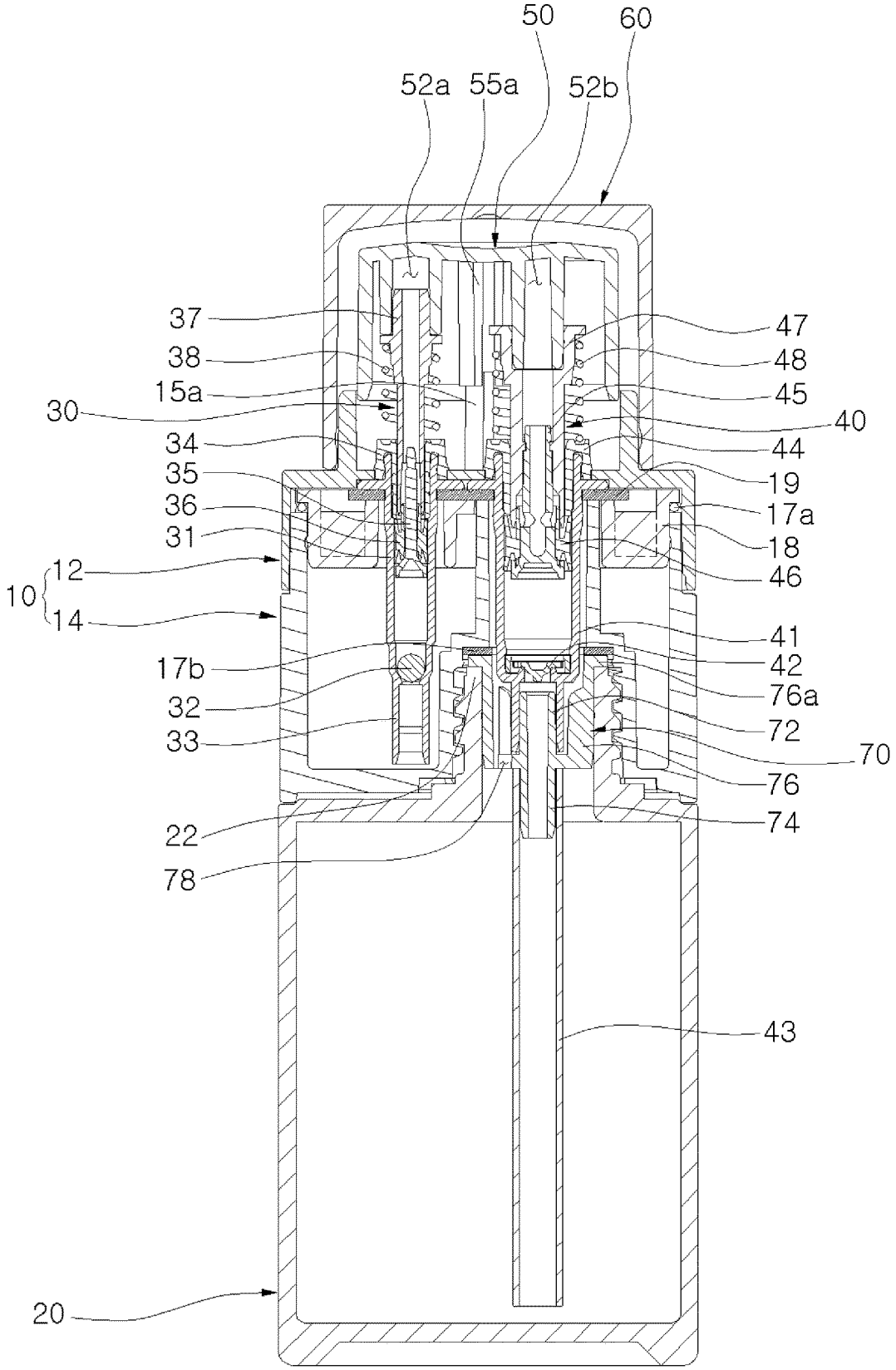
FIG. 3 is a sectional view of the mixing vessel according to the embodiment of the present invention.

FIG. 1 is a perspective view of the mixing vessel according to the embodiment of the present invention. FIG. 2 is an exploded perspective view of the mixing vessel according to the embodiment of the present invention. FIG. 3 is a sectional view of the mixing vessel according to the embodiment of the present invention.

As shown in the drawing, the mixing vessel according to one embodiment of the present invention may include a first vessel 10, a second vessel 20, a first discharge device 30, a second discharge device 40, and a push button 50.

The first vessel 10 accommodates liquid or gel first contents C1 therein and is formed in a hard cylindrical shape. The first vessel 10 is not limited to the hard cylindrical shape, and may be formed in various shapes and formed of various materials.

As shown in FIGS. 2 and 3, the first vessel 10 includes a first upper vessel 12 and a first lower vessel 14 so that the first lower vessel 14 may be coupled to the first upper vessel 12 while being inserted to a lower inside of the first upper vessel 12. Although the first upper vessel 12 is shown as being screw-coupled to the first lower vessel 14 in the drawing of the mixing vessel according to one embodiment of the present invention, it is not limited thereto, and various coupling schemes, such as undercut coupling, protrusion-and-groove coupling or force fitting coupling, may be applicable.

In addition, an elastic first sealing ring 17*a* is provided between the first upper vessel 12 and the first lower vessel 14, so that a sealing force between the first upper vessel 12 and the first lower vessel 14 may be further improved.

A support plate 13 may be provided inside the first upper vessel 12, in which the support plate 13 may be formed therein with a first discharge device installation hole 13*a* to which a first discharge device 30 is installed, and may be formed therein with a second discharge device installation hole 13*b* to which a part of entire components of the second discharge device 40 is installed.

In addition, first to third vertical guide bars 15*a*, 15*b* and 15*c* may vertically extend from a top surface of the support plate 13 so that vertical movements of the push button 50 may be guided. As shown in FIG. 2, the first vertical guide bar 15*a* may be formed as a pillar having a cross shape when viewed in a top view, and the second and third vertical guide bars 15*b* and 15*c* may be formed as a pillar bent in at least one direction to have an insertion space 15*d* therein when viewed in the top view.

The first lower vessel 14 may be formed therein with a discharge device accommodation space 14*a* for accommodating a part of the second discharge device 40, and the discharge device accommodation space 14*a* is formed at an outside thereof with a contents storage space 14*b* for accommodating a part of the first discharge device 30 while storing first contents C1. The discharge device accommodation space 14*a* may be partitioned and separated from the contents storage space 14*b* by a partition wall 14*c*, in which the partition wall 14*c* may have a cylindrical shape with an empty inside.

In addition, a connection groove 16 recessed inwardly of the first vessel 10 may be formed at a lower portion of the first lower vessel 14. In other words, when the first vessel 10 is coupled to the second vessel 20, a second housing 41 and a second suction tube 43 of the second discharge device 40 are automatically connected to each other by a connection member 70 while the connection groove 16 surrounds an outer periphery of an inlet portion 22 of the second vessel 20. In other words, after the components of the second discharge device 40 are separately installed into the first vessel 10 and the second vessel 20, the entire configuration of the separated second discharge device 40 is connected by the connection member 70 when the first vessel 10 is coupled to the second vessel 20.

The connection groove 16 of the first vessel 10 may be formed to be biased to one side from a center of the first vessel 10, and may be screw-coupled while covering the inlet portion 22 of the second vessel 20. The connection groove 16 of the first vessel 10 may be coupled to the inlet portion 22 of the second vessel 20 by various ways in addition to the screw-coupling.

In addition, as shown in FIG. 2, a sealing member 18 may be further provided between the first upper vessel 12 and the first lower vessel 14. The sealing member 18 closes an upper portion of the first lower vessel 14 while at least a part thereof being inserted into an open portion of the first lower vessel 14, and the first discharge device 30 and the second discharge device 40 pass through the sealing member 18.

A sealing plate 18 formed of an elastic material may be further provided between the sealing member 18 and the first upper vessel 12, so that sealing forces of the discharge device accommodation space 14*a* and the contents storage space 14*b* may be maintained. In addition, like the sealing member 18, the first discharge device 30 and the second discharge device 40 pass through the sealing plate 19.

As shown in FIG. 3, at least a part of the connection member 70 is fixed while being inserted into the inlet portion 22 of the second vessel 20. The connection member 70 may include an upper connection portion 72 protruding toward an open portion of the inlet portion 22 and connected to the second housing 41 of the second discharge device 40 when the first and second vessels 10 and 20 are coupled to each other, and a lower connection portion 74 protruding toward an inside of the second vessel 20 and connected to the second suction tube 43 of the second discharge device 40, and a coupling portion 76 coupled to the inlet portion 22. A falling-prevention step 76*a* may be formed on an upper end of the coupling portion 76 of the connection member 70 and seated on an upper end of the inlet portion 22 to prevent the connection member 70 from falling into the second vessel 20.

Meanwhile, at least one air flow hole 78 may be formed in outer sides of the upper connection portion 72 and the lower connection portion 74 of the connection member 70. When second contents C2 are filled inside the second vessel 20, and the connection member 70 having one side coupled to the second suction tube 43 is inserted into the second vessel 20, the air flow hole 78 may serve as a passage configured to discharge air in the second vessel 20 to the outside and serve as a passage configured to introduce air in the outside into the second vessel 20 by the exhausted amount of the second contents C2 upon use.

In addition, a second sealing ring 17*b* formed of an elastic material may be provided between an upper end of the connection member 70 and the partition wall 14*c* of the first lower vessel 14.

The first and second sealing rings 17*a* and 17*b* and the sealing plate 19 are formed of a soft material, and may be formed of at least one of materials including urethane rubber, natural rubber, elastomer, NBR (nitrile-butadiene rubber) and silicone (silicone), or at least one of elastic materials including polypropylene, polyethylene, acrylonitrile butadiene styrene (ABS), and thermos-plastic elastomer (TPE). The first and second sealing rings 17*a* and 17*b* and the sealing plate 19 are not limited to the above-described materials, and may be formed of various materials within a range having a predetermined elasticity.

The second vessel 20 may be coupled to the lower portion of the first vessel 10, and may be formed in a cylindrical shape corresponding to the first vessel 10 for the continuity of appearance of the mixing vessel.

The second contents C2 may be stored in the second vessel 20. The second contents C2 are different from the first contents C1, and may increase the efficacy or effect when used in combination with the first contents C1.

The inlet portion 22 is formed at one side of the second vessel 20, in which the inlet portion 22 is coupled to the first vessel 10 and serves as a filling inlet into which the second contents C2 are filled. The inlet portion 22 may be formed on an outer circumference thereof with a thread so as to be screw-coupled to at thread formed on the connection groove 16 of the first vessel 10. In addition, before the second vessel 20 is coupled to the first vessel 10, the second vessel 20 may be individually packaged, distributed and sold separately from the first vessel 10. In this case, a temporary cover 23 may be coupled to the inlet portion 22 of the second vessel 20.

In addition, the connection member 70 is inserted and fixed inside the inlet portion 22, and the second suction tube of the second discharge device 40 is coupled to the lower portion of the connection member 70 and positioned inside the second vessel 20.

As described above, after the first vessel 10 and the second vessel 20 are separately packaged, distributed and sold, the inlet portion 22 of the second vessel 20 may be inserted and coupled to the connection groove 16 of the first vessel 10 for use. When the upper connection portion 72 of the connection member 70 coupled to the second vessel 20 is inserted into a lower portion of the second housing 41 of the second discharge device 40, the upper connection portion 72 is coupled to the second discharge device 40 separately installed to the first vessel 10 and the second vessel 20, and the connection groove 16 of the first vessel 10 is simultaneously screw-coupled to the outer periphery of the inlet portion 22 of the second vessel 20 while surrounding the outer periphery.

Accordingly, the first vessel 10 can be more simply coupled to the second vessel 20, the first contents C1 can be prevented from being contaminated by external foreign substances in the process of coupling the second vessel 20, and the sealing of the second vessel 20 can be stably maintained even before and after the first vessel is coupled to the second vessel 20.

Although the first vessel 10 is shown as being screw-coupled to the second vessel 20 in the drawing of the mixing vessel according to one embodiment of the present invention, it is not limited thereto, and various coupling schemes, such as undercut coupling, protrusion-and-groove coupling or force fitting coupling, may be applicable.

The first discharge device 30 is installed in the first discharge device installation hole 13*a* of the first vessel 10 while at least a part of the first discharge device 30 being inserted into the contents storage space 14*b* of the first vessel 10, and discharges the first contents C1 stored in the first vessel 10 to the outside.

The first discharge device 30 may be a pump configured to discharge a fixed amount of the contents to the outside by a pumping action.

As shown in FIG. 3, the first discharge device 30 may include: a first housing 31 formed at one side thereof with a first contents suction hole 31*a*; a first suction valve 32 configured to open and close the first contents suction hole 31*a* of the first housing 31; a first suction tube 33 coupled to a lower portion of the first housing 31 to suck the first contents C1 into the first housing 31; a first housing cap 34 fixedly coupled to an upper portion of the first housing 31; a first piston support 35 formed inside the first housing 31 to vertically move inside the first housing 31; a first piston 36 fitted to an outer side of the first piston support 35 to come into close contact with an inner surface of the first housing 31; a first stem 37 coupled to an upper portion of the first piston support 35; and a first spring 38 configured to elastically support the first stem 37.

The second discharge device 40 is installed in the second discharge device installation hole 13*b* while a partial component of entire components being inserted into the discharge device accommodation space 14*a* of the first vessel 10, and remaining components are installed inside the second vessel 20. In other words, after the components of the second discharge device 40 are divided and installed into the first vessel 10 and the second vessel 20, respectively, the entire components of the second discharge device 40 are connected by the connection member 70 so as to be in an operable state at the moment when the first vessel 10 is coupled to the second vessel 20.

The second discharge device 40 discharges the second contents C2 stored in the second vessel 20 to the outside. The second discharge device 40 may be a pump configured to discharge a fixed amount of the contents to the outside by the pumping action.

As shown in FIG. 3, the second discharge device 40 may include: a second housing 41 formed at one side thereof with a second contents suction hole 41*a*; a second suction valve 42 configured to open and close the second contents suction hole 41*a* of the second housing 41; a second suction tube 43 configured to suck the second contents C2 stored in the second vessel 20 into the second housing 41; a second housing cap 44 coupled to an upper portion of the second housing 41 to fix the second housing 41 to one side of the second vessel 20; a second piston support 45 formed inside the second housing 41 to vertically move inside the second housing 41; a second piston 46 fitted to an outer side of the second piston support 55 to come into close contact with an inner surface of the second housing 41; a second stem 47 coupled to an upper portion of the second piston support 45; and a second spring 48 configured to elastically support the second stem 47.

The second housing 41, the second suction valve 42, the second housing cap 44, the second piston support 45, the second piston 46, the second stem 47, and the second spring 48 of the second discharge device 40 are installed to the support plate 13 of the first vessel 10, but the second suction tube 43 of the second discharge device 40 is installed inside the second vessel 20 through the connection member 70. In other words, the second housing 41 of the second discharge device 40 is installed to the first vessel 10, the second suction tube 43 of the second discharge device 40 is installed to the connection member 70 so as to be inserted into the first second vessel 20, such that the second housing 41 and the second suction tube 43 of the second discharge device 40 are automatically connected to each other by the connection member 70 when the first vessel 10 is coupled to the second vessel 20.

Meanwhile, the first discharging device 30 and the second discharging device 40 may have a size and a structure different from each other according to the using ratio between the first and second contents C1 and C2 to be pumped. For example, when the first contents C1 discharged by the first discharge device 30 are configured to be discharged, mixed and used more than the second contents C1 discharged by the second discharge device 40, a piston stroke distance and a cylinder inner diameter of the first discharge device 30 may be greater than those of the second discharge device 40.

The push button 50 is coupled to the first vessel 10 so as to move up and down to simultaneously actuate the first and second discharge device 30 and 40, when pressed by a press action of the user.

First and second discharge passages 52*a* and 52*b* connected to the first and second discharge device 30 and 40 are formed inside the push button 50, respectively, and first and second discharge ports 54*a* and 54*b* are formed at one end portions exposed to the outside of the first and second discharge passages 52*a* and 52*b*, respectively.

The first discharge passage 52*a* of the push button 50 is connected to the first stem 37 of the first discharge device 30 to allow the first contents C1 pumped by the first discharge device 30 to move to the first discharge port 54*a*, and the second discharge passage 52*b* is connected to the second stem 47 of the second discharge device 30 to allow the second contents C2 pumped by the second discharge device 40 to move to the second discharge port 52*b*.

As shown in FIG. 1, the first and second discharge ports 54*a* and 54*b* may be formed left and right at outer sides of the push button 50, respectively. In other words, the first discharge port 54*a* and the second discharge port 54*b* are arranged parallel and adjacent to each other, so that the first contents C1 discharged from the first discharge port 54*a* and the second contents C2 discharged from the second discharge port 54*b* may be easily mixed with each other and used. The positions of the first discharge port 54*a* and the second discharge port 54*b* may be variously changed by taking usability, aesthetics, and consumer tastes into consideration.

As shown in FIG. 2, the first to third vertical guide portions 55*a*, 55*b* and 55*c* may downwardly extend inside the push button 50 to guide the vertical movements of the push button 50 together with the first and third vertical guide bars 15*a*, 15*b*, and 15*c* of the first vessel 10. the first vertical guide portion 55*a* is formed with an insertion groove 55*d* having a cross shape to which the first vertical guide bar 15*a* is inserted when viewed in a bottom view. The second and third vertical guide portions 55*b* and 55*c* are inserted into the insertion spaces 15*d* of the second and third vertical guide bars 15*b* and 15*c*.

In addition, the first vessel 10 may be further coupled to a vessel cover 60 configured to surround and protect the push button 50 when carried or stored.

FIGS. 4 to 8 are views illustrating the assembly and use of the heterogeneous contents mixing vessel according to one embodiment of the present invention. The assembly and use of the heterogeneous content mixing vessel according to one embodiment of the present invention will be described with reference to the above drawings.

Figure 4:
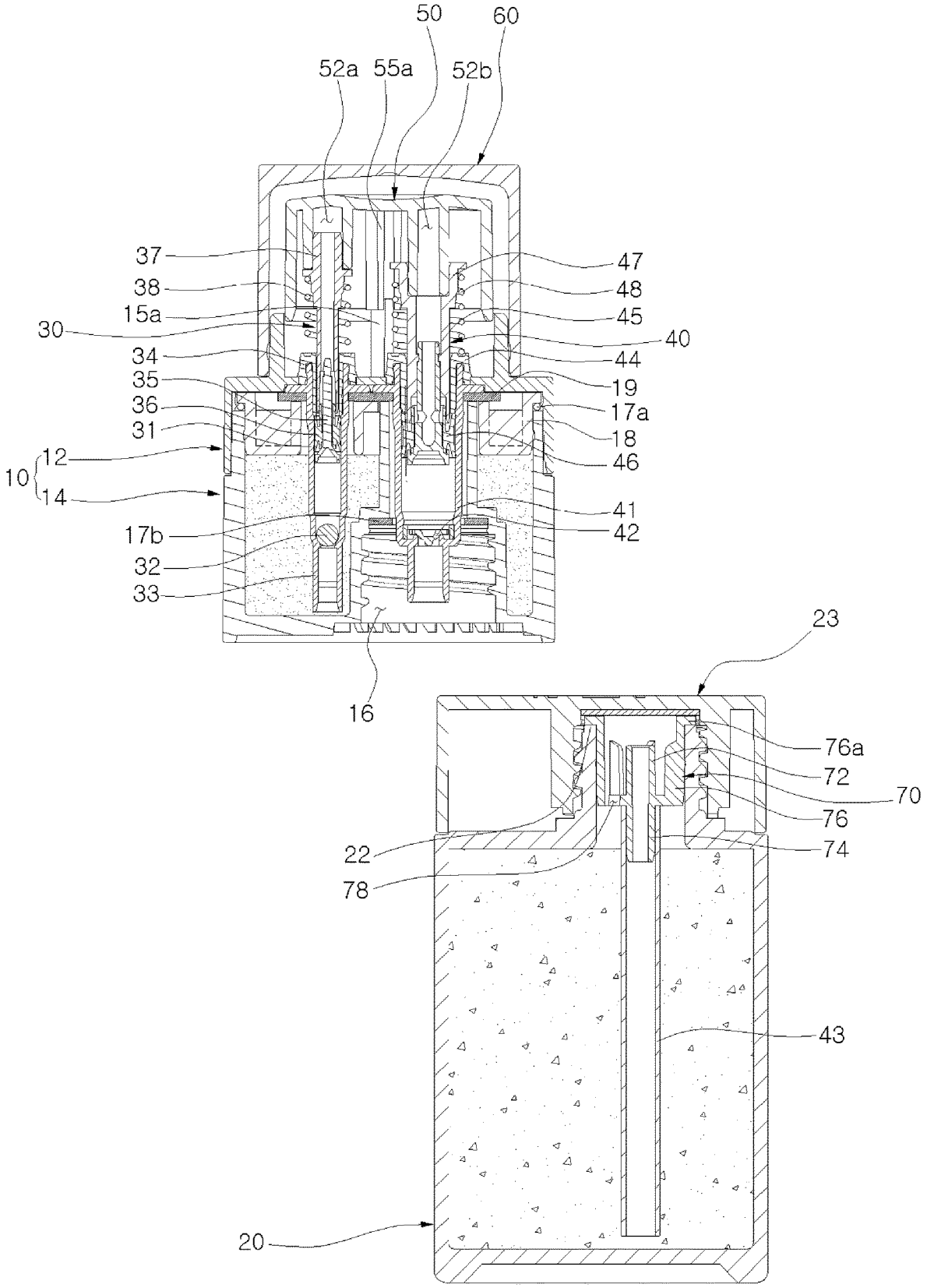
FIG. 4 is a sectional view illustrating a state before a second vessel is couple to a first vessel according to the embodiment of the present invention.
Figure 5:
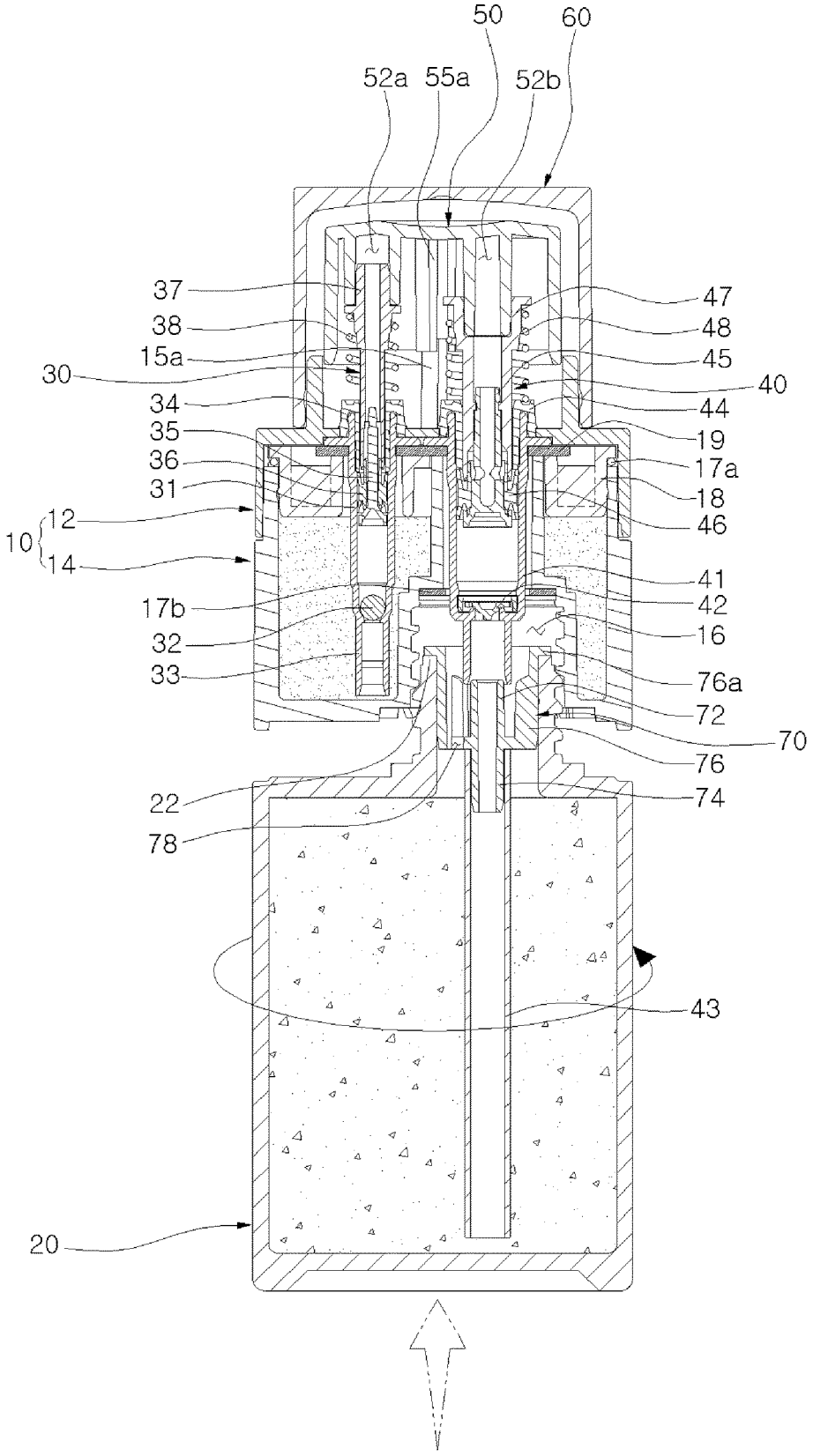
FIG. 5 a sectional view illustrating a state in which the first vessel is coupled to the second vessel according to the embodiment of the present invention.
Figure 6:
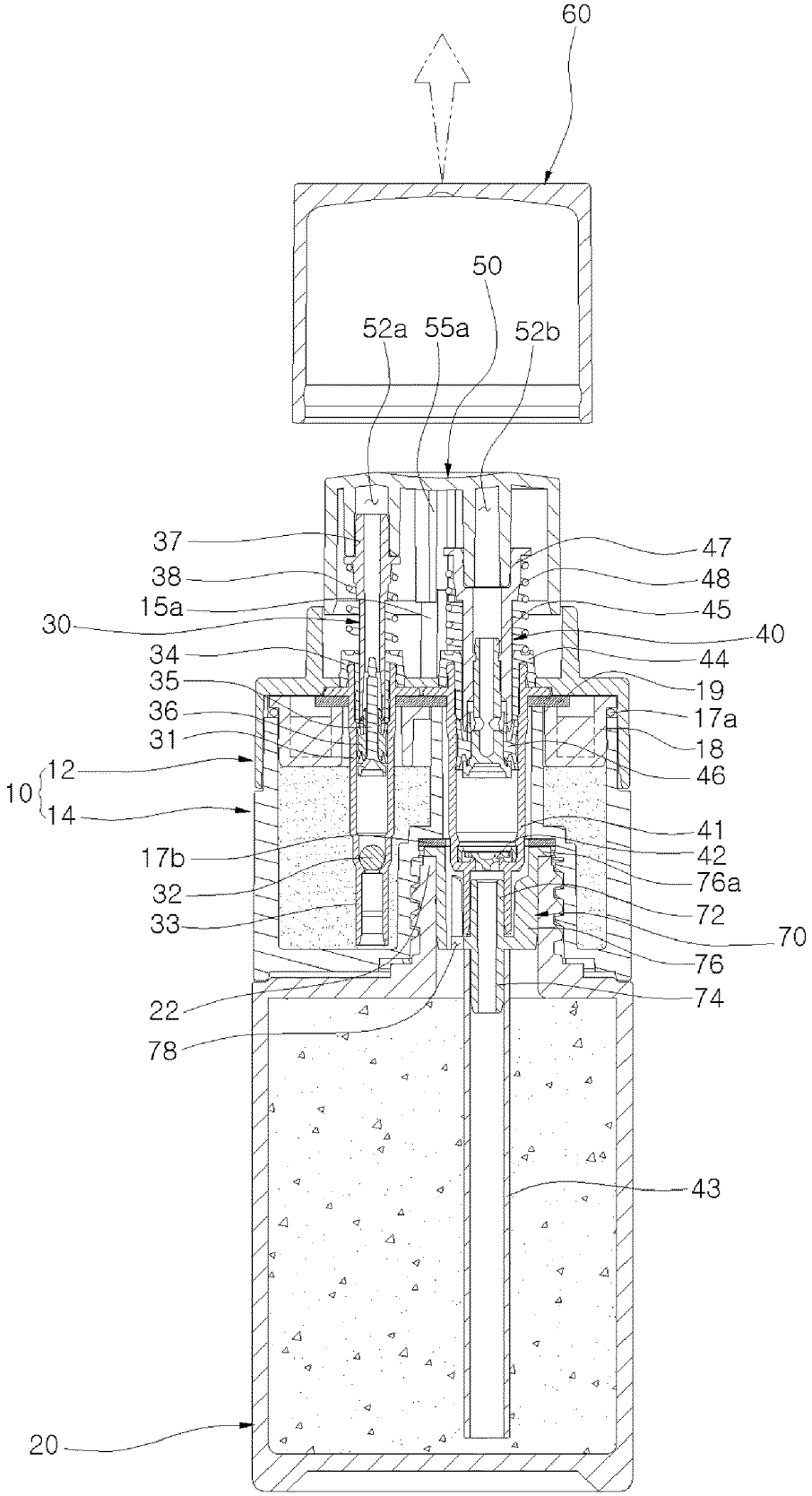
FIG. 6 is a sectional view illustrating a state in which a vessel cover is separated from the first vessel of the mixing vessel according to the embodiments of the present invention.
Figure 7:
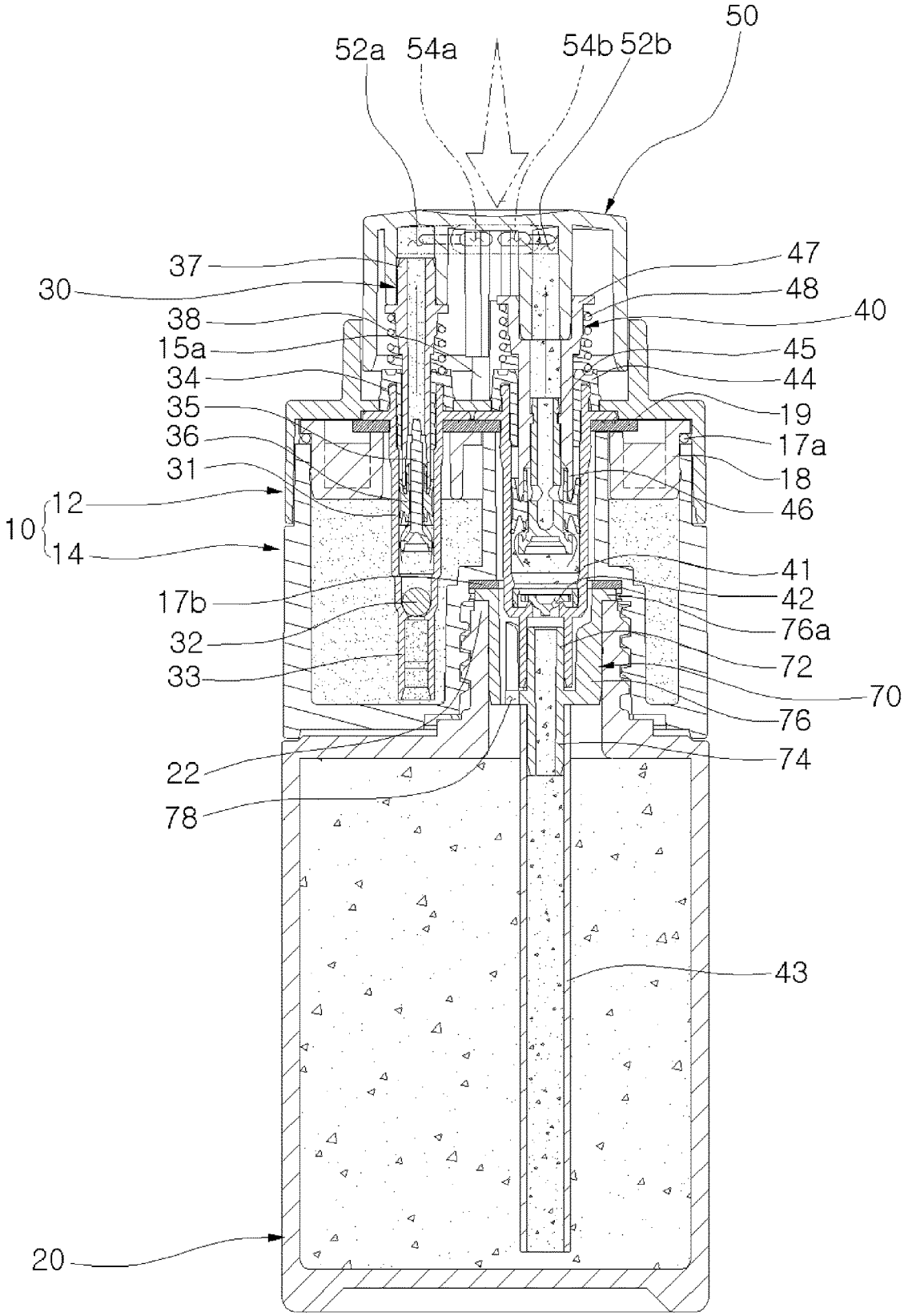
FIG. 7 is a sectional view showing a state in which heterogeneous contents are simultaneously discharged when a push button of the mixing vessel according to the embodiment of the present invention is pushed.
Figure 8:
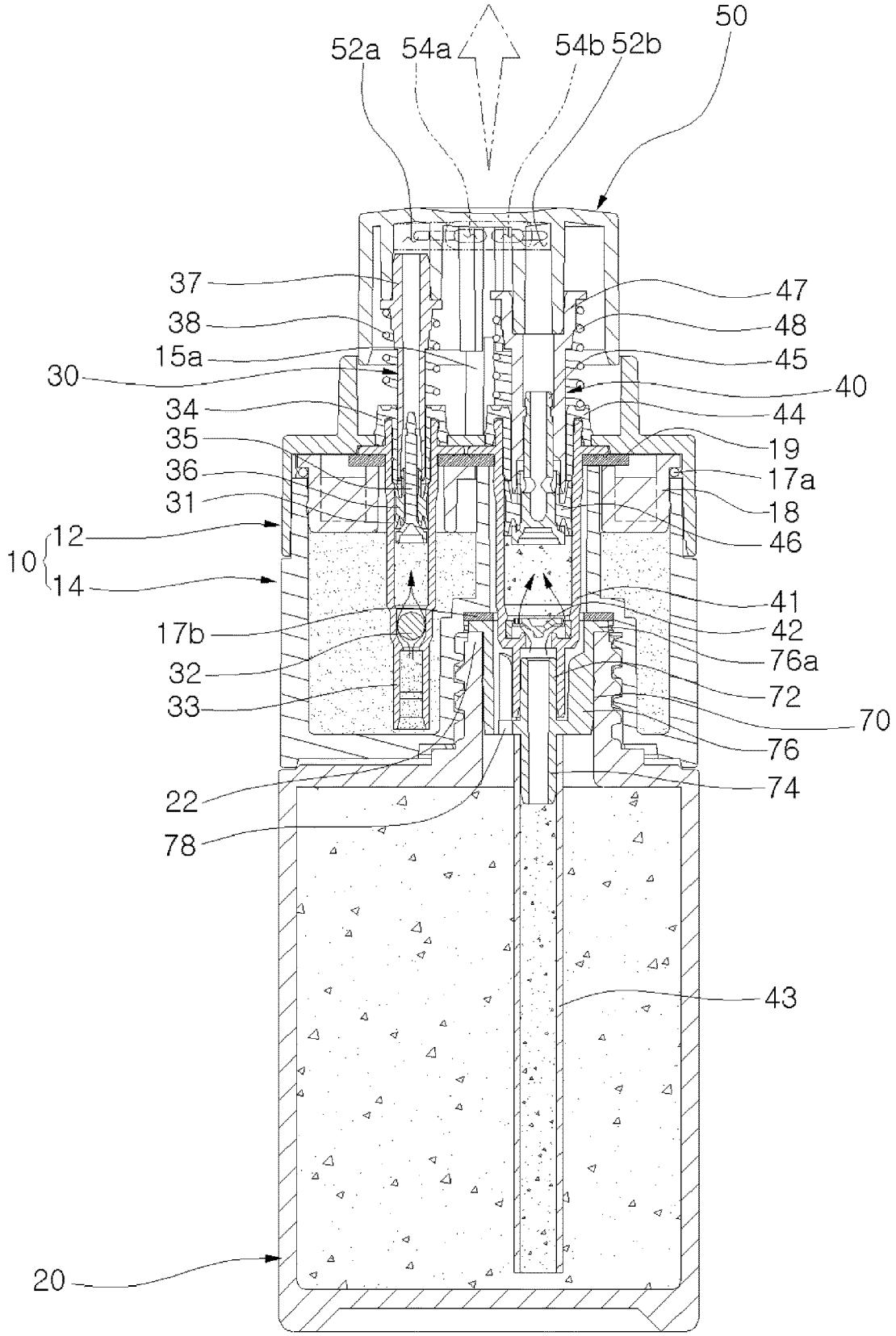
FIG. 8 is a sectional view showing a state in which the contents are introduced into first and second discharge devices while the push button of the mixing vessel according to an embodiment of the present invention is restored to an original position.

FIG. 4 is a sectional view illustrating a state before a second vessel is couple to a first vessel according to the embodiment of the present invention. FIG. 5 is a sectional view illustrating a state in which the first vessel is coupled to the second vessel according to the embodiment of the present invention. FIG. 6 is a sectional view illustrating a state in which the vessel cover is separated from the first vessel of the mixing vessel according to the embodiment of the present invention. FIG. 7 is a sectional view showing a state in which heterogeneous contents are simultaneously discharged when the push button of the mixing vessel according to the embodiment of the present invention is pushed. FIG. 8 is a sectional view showing a state in which the contents are introduced into first and second discharge devices while the push button of the mixing vessel according to an embodiment of the present invention is restored to an original position.

First, in order to assemble the mixing vessel according to one embodiment of the present invention, as shown in the drawings, the first discharge device 30, which includes the first housing 31, the first suction valve 32, the first suction tube 33, and the first housing cap 34, the first piston support 35, the first piston 36, the first stem 37, and the first spring 38, is installed to the first discharge device installation hole 13*a* of the first upper vessel 12, and the second housing 41, the second suction valve 42, the second housing cap 44, and the second piston support 45, the second piston 46, the second stem 47, and the second spring 48 among the entire components of the second discharge device 40 are installed to the second discharge device installation hole 13*b*.

Next, the push button 50 is coupled to the first upper vessel 12 so as to move vertically, in which the first and second discharge passages 52*a* and 52*b* of the push button 50 are connected to the first stem 37 of the first discharge device 30 and the second stem 47 of the second discharge device 40, respectively. At the same time, the second and third vertical guide portions 55*b* and 55*c* of the push button 50 are inserted into the insertion space 15*d* of the second and third vertical guide bars 15*b* and 15*c* formed in the first vessel 10, and the first vertical guide bar 15*a* of the first vessel 10 is inserted into the insertion groove 55*d* formed in the first vertical guide portion 55*a* of the push button 50.

Next, the liquid or gel first contents C1 are filled in the contents storage space 14*b* of the first lower vessel 14, the sealing member 18 is inserted to the open upper portion of the first lower vessel 14, and the first upper vessel 12 is coupled to the first lower vessel 14 while surrounding the upper portion of the first lower vessel 14.

At this time, the first sealing ring 17*a* is inserted between the first lower vessel 14 and the sealing member 18, the sealing plate 19 is inserted between the sealing member 18 and the first upper vessel 12, and the second sealing ring 17*b* is attached to the inner upper end of the connection groove 16 of the first lower vessel 14.

Next, after the liquid or gel second content C2 are filled inside the second vessel 20, the connection member 70 is inserted and fixed inside the inlet portion 22 of the second vessel 20. In this state, the second suction tube 43 of the second discharge device 40 has been coupled to the lower connection portion 74 of the connection member 70.

Next, as shown in FIG. 4, the first vessel 10 and the second vessel 20 assembled in the above-described manner are separately packaged. The connection groove 16 of the first vessel 10 is sealed and the temporary cover 23 is coupled to the inlet portion 22 of the second vessel 20, such that foreign substances may be prevented from permeating into the first and second vessels 10 and 20 during distribution or storage.

Meanwhile, when the mixing vessel assembled in the above-described manner, the inlet portion 22 of the second vessel 20 is inserted into the connection groove 16 formed in the lower portion of the first vessel 10 and screw-coupled with rotation, as shown in FIG. 5. The connection groove 16 of the first vessel 10 is coupled to the second vessel 20 while surrounding the outer periphery of the inlet portion 22 of the second vessel 20. At the same time, the upper connection portion 72 of the connection member 70 coupled to the second vessel 20 is inserted into the lower portion of the second housing 41 of the second discharge device 40, so that the components of the second discharge device 40, which are separately installed in the first vessel 10 and the second vessel 20, are connected to each other. Accordingly, the first contents C1 stored in the first vessel 10 and the second contents C2 stored in the second vessel 20 are in a state to be discharged together through the first and second discharge device 30 and 40.

Then, as shown in FIG. 6, the vessel cover 60 is removed from the first vessel 10. As shown in FIG. 7, the first contents C1 stored in the first vessel 10 and the second contents C2 stored in the second vessel 20 are discharged together while simultaneously the first discharge device 30 and the second discharge device 40 are simultaneously actuated by pressing the push button 50, and thus the different contents discharged in the above manner are mixed and used.

More particularly, when the first and second discharge device 30 and 40 are pressed together, the first and second stems 37 and 47 and the first and second piston supports 35 and 45 coupled to lower portions of the first and second stems 37 and 47 move downward. Since the first and second pistons 36 and 46 of the first and second discharge device 30 and 40 come into close contact with inner surfaces of the first and second housings 31 and 41, only the first and second piston supports 35 and 45 move downward, thereby generating gaps between the first and second piston supports 35 and 45 and the first and second pistons 36 and 46, and thus discharge passages of the first and second contents C1 and C2 are generated.

Then, the lower ends of the first and second stems 37 and 47, which are moving downward, press the first and second pistons 36 and 46, so that the first and second pistons 36 and move downward together with the first and second piston supports 35 and 45, thereby reducing volumes inside the first and second housings 31 and 41. Accordingly the first and second suction valves 32 and 42 close the first and second contents suction ports 31*a* and 41*a* due to discharge pressures in the first and second housings 31 and 41, and the first and second contents C1 and C2 accommodated in the first and second housings 31 and 41 come out between the first and second piston supports and 45 and the first and second pistons 36 and 46, pass through the inside of the first and second piston supports 35 and 45 and the first and second discharge passages 52*a* and 52*b*, and are discharged to the first and second discharge ports 54*a* and 54*b*, respectively.

Then, as shown in FIG. 8, when the pressure of the push button 50 is released, the first and second stems 37 and 47 and the first and second piston supports 35 and 45 coupled to the lower side of the first and second stems 37 and 47 move upward due to the elasticities the first and second springs 38 and 48 for elastically supporting the first and second stems 37 and 47. At this time, the lower portions of the first and second piston supports 35 and 45 pull the first and second pistons 36 and 46 upward, thereby closing the gaps between the first and second piston supports 35 and 45 and the first and second pistons 36 and 46, so that the first and second piston supports and 45 upwardly move together with the first and second pistons 36 and 46.

Accordingly, vacuum pressures are generated due to increases of volumes inside the first and second housings 31 and 41, and the first and second suction valves 32 and 42 are lifted by the vacuum pressure, thereby opening the first and second contents suction ports 31*a* and 41*a*, so that the first and second contents C1 and C2 stored in the first and second vessels 10 and 20 are introduced into the first and second housings 31 and 41, respectively.

Then, the different contents discharged in the above manner are mixed and used.

Although the invention has been described with the particulars such as specific elements, the limited embodiments, and the drawings, it is obvious that the particulars are provided only to help comprehensive understanding of the invention, the present invention is not limited to the embodiments, and various changes and modifications may be carried out by those skilled in the art.

Therefore, the spirit of the present invention should not be limited to the aforementioned embodiments, and the following claims as well as all modifications or variations belonging to the equivalents of the claims will be within the scope of the invention.

What is claimed is:

1. A heterogeneous contents mixing vessel comprising:

a first vessel formed therein with a content storage space and a discharge device accommodation space that are separately defined;

a second vessel coupled to a lower portion of the first vessel;

first and second discharge devices configured to discharge contents stored in the first vessel and contents stored in the second vessel, respectively; and a push button configured to simultaneously actuate the first and second discharge devices and formed therein with first and second discharge passages connected to the first and second discharge devices, respectively, and first and second discharge ports, wherein a connection groove formed in the first vessel and an inlet portion formed in the second vessel are coupled to each other so that a separated second discharge device is connected through a connection member.

2. The heterogeneous contents mixing vessel of claim 1, wherein the first vessel and the second vessel are screw-coupled to each other.

3. The heterogeneous contents mixing vessel of claim 1, wherein the connection groove of the first second vessel and the inlet portion of the second vessel are biased to one sides from centers of the first and second vessels.

4. The heterogeneous contents mixing vessel of claim 1, wherein the first and second discharge devices include pumps configured to discharge the contents to the outside by pumping.

5. The heterogeneous contents mixing vessel of claim 1, wherein a second housing of the second discharge device is installed to the first vessel, a second suction tube of the second discharge device is installed to the connection member and inserted into the second vessel, and the second housing and the second suction tube of the second discharge device are automatically connected to each other by the connection member when the first vessel is coupled to the second vessel.

6. The heterogeneous contents mixing vessel of claim 1, wherein the connection member is provided at the inlet portion of the second vessel and includes an upper connection portion protruding toward the open portion of the inlet portion and connected to a second housing of the second discharge device when the first and second vessels are coupled to each other, a lower connection portion protruding toward an inside of the second vessel and connected to a second suction tube of the second discharge device, and a coupling portion coupled to the inlet portion.

7. The heterogeneous contents mixing vessel of claim 6, wherein at least one air flow hole is formed in outer sides of the upper connection portion and the lower connection portion of the connection member.

8. The heterogeneous contents mixing vessel of claim 1, wherein the first vessel includes a first upper vessel and a first lower vessel that are coupled to each other.

9. The heterogeneous contents mixing vessel of claim 8, wherein the first upper vessel is formed therein with a support plate to which the first discharge device and the second discharge device are partially installed.

10. The heterogeneous contents mixing vessel of claim 8, wherein a sealing member is formed between the first upper vessel and the first lower vessel to block an open portion of the first lower vessel, and the first discharge device and the second discharge device pass through the sealing member.

* * * * *